US010538923B2

(12) United States Patent
Marchetti et al.

(10) Patent No.: US 10,538,923 B2
(45) Date of Patent: Jan. 21, 2020

(54) ANTI-SEISMIC ACCESS FLOOR

(71) Applicant: SCHNEIDER ELECTRIC IT CORPORATION, West Kingston, RI (US)

(72) Inventors: Daniele Marchetti, Chioggia (IT); Alberto Caporali, Bariano (BG); Renato Pasini, Torreglia (IT)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 0 days.

(21) Appl. No.: 15/864,816

(22) Filed: Jan. 8, 2018

(65) Prior Publication Data

US 2018/0195293 A1 Jul. 12, 2018

(30) Foreign Application Priority Data

Jan. 9, 2017 (IT) ..... 102017000001518

(51) Int. Cl.
*E04F 15/024* (2006.01)
*E04B 1/98* (2006.01)

(52) U.S. Cl.
CPC ..... *E04F 15/02452* (2013.01); *E04B 1/98* (2013.01); *E04F 15/02405* (2013.01)

(58) Field of Classification Search
CPC .... E04B 1/98; E04F 15/02405; E04F 15/2452
(Continued)

(56) References Cited

U.S. PATENT DOCUMENTS 3,150,748 A * 9/1964 Liskey, Jr. ..... E04F 15/02405 52/396.04
3,316,680 A * 5/1967 Chrastek ..... E04F 15/02458 52/126.6

(Continued)

FOREIGN PATENT DOCUMENTS

CN 2720773 Y 8/2005
CN 204401961 U 6/2015

(Continued)

OTHER PUBLICATIONS

Italian Search Report from corresponding Italian Application No. 102017000001518 dated Jul. 19, 2017.

*Primary Examiner* — Joshua J Michener
*Assistant Examiner* — James J Buckle, Jr.
(74) *Attorney, Agent, or Firm* — Lando & Anastasi, LLP

(57) ABSTRACT

A flooring assembly includes a base for supporting at least one flooring element. A pin is secured to the base and extends from the upper surface of the base. The pin has a body portion adjacent to the base and a head portion extending upwardly from the body portion. The head portion has a lower head surface. A recess is formed in a flooring element. A collar is positioned adjacent to the recess. The collar has an inner diameter that is less than a diameter of the recess. The collar has an upper collar surface configured to engage the lower head surface to limit a vertical motion of the flooring element with respect to the base when a central vertical axis of the pin is laterally offset from a central vertical axis of the recess. In some embodiments, petals secured in the recess are used instead of a collar.

20 Claims, 12 Drawing Sheets

(58) Field of Classification Search
USPC ..... 52/167.1, 220.1, 220.2, 262, 263
See application file for complete search history.

(56) References Cited

U.S. PATENT DOCUMENTS

| | | | | | |
|---|---|---|---|---|---|
| 3,616,584 | A * | 11/1971 | Sartori et al. | E04F 15/02452 | 52/126.6 |
| 4,279,109 | A | 7/1981 | Madl, Jr. | | |
| 4,996,804 | A * | 3/1991 | Naka | E04F 15/02452 | 52/126.1 |
| 5,074,085 | A * | 12/1991 | Ueda | E04F 15/02476 | 248/916 |
| 5,386,670 | A * | 2/1995 | Takeda | E04F 15/02411 | 52/126.6 |
| 5,400,554 | A * | 3/1995 | Lo | E04F 15/02411 | 52/126.2 |
| 5,459,968 | A * | 10/1995 | Jin | E04F 15/02476 | 52/126.2 |
| 5,588,269 | A * | 12/1996 | Wagner | E04B 1/10 | 52/220.2 |
| 5,628,157 | A * | 5/1997 | Chen | E04F 15/02458 | 52/220.2 |
| 5,791,096 | A * | 8/1998 | Chen | E04F 15/02458 | 52/126.6 |
| 5,904,015 | A * | 5/1999 | Chen | E04F 15/02494 | 52/220.2 |
| 6,293,062 | B1 * | 9/2001 | Chen | E04F 15/02429 | 52/126.5 |
| 6,330,770 | B1 * | 12/2001 | Fukunaga | E04F 15/02447 | 174/482 |
| 6,336,296 | B1 * | 1/2002 | Ishibashi | E04F 15/02405 | 52/167.1 |
| 6,370,831 | B1 * | 4/2002 | Marshall | E04F 15/02405 | 52/126.1 |
| 6,918,217 | B2 * | 7/2005 | Jakob-Bamberg | E04B 5/48 | 52/220.1 |
| 7,001,098 | B2 | 2/2006 | Lin et al. | | |
| 7,140,156 | B1 * | 11/2006 | Lowe, Jr. | E04F 15/02183 | 52/263 |
| 7,373,759 | B1 * | 5/2008 | Simmons | E04F 15/024 | 248/188.1 |
| 8,776,452 | B1 * | 7/2014 | DeJonge | E04F 15/06 | 52/126.1 |
| 8,898,999 | B1 * | 12/2014 | Kugler | E04F 15/02464 | 52/126.6 |
| 9,410,296 | B2 * | 8/2016 | Tabibnia | E01C 5/00 | |
| 9,499,992 | B2 * | 11/2016 | Busby | E04F 15/02044 | |
| 9,670,681 | B2 * | 6/2017 | Buzon | E04F 15/02452 | |
| 9,879,385 | B2 * | 1/2018 | Tabibnia | F24D 3/127 | |
| 10,106,991 | B2 * | 10/2018 | Dombrowski | E04D 11/007 | |
| 2002/0026757 | A1 | 3/2002 | Scissom et al. | | |
| 2003/0177723 | A1 * | 9/2003 | Jakob-Bamberg | E04B 5/48 | 52/263 |
| 2009/0084066 | A1 * | 4/2009 | Brown | E04F 15/02429 | 52/745.19 |
| 2015/0252574 | A1 | 9/2015 | Kugler et al. | | |

FOREIGN PATENT DOCUMENTS

| | | | |
|---|---|---|---|
| DE | 202012006304 | U1 | 9/2012 |
| EP | 1247922 | A2 | 10/2002 |
| GB | 381283 | A | 10/1932 |
| JP | 2008063939 | A | 3/2008 |

* cited by examiner

A - A

ANTI-SEISMIC ACCESS FLOOR

CROSS-REFERENCE TO RELATED APPLICATIONS

This application claims the benefit under 35 U.S.C. § 119 of Italian Patent Application No. 102017000001518 filed on Jan. 9, 2017 which is hereby incorporated herein by reference in its entirety for all purposes.

FIELD OF THE INVENTION OF THE DISCLOSURE

The present disclosure relates to a system designed for connecting raised flooring elements to base supports of an underfloor substructure. In particular, the present disclosure relates to a system designed for connecting raised flooring elements to the base supports of an underfloor substructure, where the flooring elements are configured for supporting electronic components.

BACKGROUND OF THE DISCLOSURE

Typically an access floor includes a metallic frame and tiles placed on the metallic frame. In the case of a seismic event, the tiles can overlap each other, drop down from the frame, and/or be distorted.

FIG. 1 shows a top view of a plurality of flooring elements, each indicated at 10, arranged in an array 12 during normal use. FIG. 2 shows how lateral loads A, B due to seismic activity can cause the flooring elements 10 to shift with respect to each other, so they are no longer aligned in the array 12. FIG. 3 shows how a primarily horizontal load C and a primarily vertical load D, both caused by seismic activity, can cause one flooring element 10A to overlap an adjacent flooring element 10B.

EP 2322739 discloses a support for raised flooring elements. A connection element is provided between a bottom face of a flooring element and a bearing surface of a top end of a support said connection element. A first coupling means is designed to fit into corresponding seats formed in the bottom face of the flooring element.

However, the structure of EP 2322739 does not retain the flooring element on the support under seismic loads.

SUMMARY OF THE DISCLOSURE

According to one aspect of the present disclosure, a flooring assembly includes a base having an upper surface. A pin is secured to the base and extends from the upper surface of the base. The pin has a body portion adjacent to the base and a head portion extending upwardly from the body portion. The head portion has a lower head surface. A flooring element has a recess formed therein. The recess has a diameter. A collar is positioned adjacent to the recess. The collar has an inner diameter that is less than the diameter of the recess. The collar has an upper collar surface configured to engage the lower head surface to limit a vertical motion of the flooring element with respect to the base when a central vertical axis of the pin is laterally offset from a central vertical axis of the recess.

In some embodiments, the pin has a tapered neck portion extending upwardly from the body portion and connecting the body portion to the head portion.

In some embodiments, the head portion has an annular head wall, the lower head surface extending inwardly from the annular head wall, the neck portion has a tapered neck wall depending downwardly and radially outwardly from the lower head surface, and the body portion has an annular body wall depending from the tapered neck wall.

In some embodiments, the collar has a tapered inner wall configured to engage the tapered neck wall.

In some embodiments, the annular body wall has an annular body diameter equal to a diameter of the annular head wall.

In some embodiments, the collar is seated in an annular recess defined in the flooring element.

In some embodiments, the flooring assembly includes a gasket positioned on the upper surface of the base, and the gasket has an upper surface configured to engage the flooring element.

In some embodiments, the base has an opening formed therein and the pin has at least one latching tab extending from a lower end of the body portion of the pin. Each latching tab has a flexible arm, and the latching tab has a latching surface configured to releasably engage a lower surface of the base when the flexible arm extends through the opening to secure the pin to the base.

In some embodiments, the pin is secured to the base by a threaded fastener or a weld.

In some embodiments, the recess of the flooring element includes a first counterbore and a second counterbore recessed from the first counterbore. A diameter of the first counterbore is greater than a diameter of the second counterbore. The first counterbore and the second counterbore are positioned at a corner of the flooring element.

In some embodiments, the pin includes a material selected from a metal and a plastic.

According to another aspect of the present disclosure, a flooring assembly includes a base having an upper surface. A pin is secured to the base and extends from the upper surface of the base. The pin has a body portion adjacent to the base and a head portion extending upwardly from the body portion. The head portion has a lower head surface. A flooring element has a locking structure having at least two petals. Each petal has a locking surface configured to releasably engage the lower head surface.

In some embodiments, the flooring assembly includes a ring that is movable from a first position to a second position. The ring is configured to retain the at least two petals in engagement with the lower head surface of the head portion when the ring is in the first position. The ring is configured to allow the lower head surface to disengage the at least two petals when the ring is in the second position.

In some embodiments, the ring is magnetic so that a magnetic field is capable of moving the ring from the first position to the second position.

According to another aspect of the present disclosure, a method of constructing a flooring assembly includes providing a base having an upper surface; providing a pin secured to the base and extending from the upper surface of the base, the pin having a body portion adjacent to the base and a head portion extending upwardly from the body portion, the head portion having a lower head surface; providing a flooring element having a recess formed therein, the recess having a diameter, the flooring element having a collar positioned adjacent to the recess, the collar having an inner diameter that is less than the diameter of the recess, the collar having an upper collar surface configured to engage the lower head surface to limit a vertical motion of the flooring element with respect to the base when a central vertical axis of the pin is laterally offset from a central vertical axis of the recess; and positioning the flooring element on the base by aligning a center axis of the pin with a center axis of the collar, and lowering a lower surface of the flooring element so that the pin is received in the recess.

In some embodiments, the method includes removing the flooring element from the base by aligning the center axis of the pin with the center axis of the collar and moving the flooring element vertically upward with respect to the base.

In some embodiments, the pin has a tapered neck portion extending upwardly from the body portion and connecting the body portion to the head portion.

In some embodiments, the head portion has an annular head wall, the lower head surface extending inwardly from the annular head wall, the neck portion having a tapered neck wall depending downwardly and radially outwardly from the lower head surface, and the body portion having an annular body wall depending from the tapered neck wall.

In some embodiments, the collar has a tapered inner wall configured to engage the tapered neck wall.

In some embodiments, the annular body wall has an annular body diameter equal to a diameter of the annular head wall.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF THE DISCLOSURE

The present disclosure relates generally to a system designed to connect raised flooring elements to base supports of an underfloor substructure. In particular, the present disclosure relates to a system designed to connect raised flooring elements to the base supports of an underfloor substructure, where the flooring elements are configured to support electronic components. Earthquakes typically generate vertical and horizontal forces. Resulting seismic body waves and surface waves typically cause flooring elements to oscillate and tremble, and can gradually lift the flooring elements from the respective rest positions. These seismic forces can ultimately cause some or all of the flooring elements, or rows of flooring elements, to partially overlap adjacent flooring elements, or rows of flooring elements. Consequently, the support structure for the flooring elements becomes weaker and can be deformed and the flooring elements may fall off of the base supports. The weakening of the support structure results in the collapse of the flooring system, which is a safety hazard for people and equipment supported on the flooring elements, and possibly for people and equipment nearby.

The anti-seismic access floor of the present disclosure is useful for supporting electronic components while providing a strong connection between an access floor base support structure and flooring elements (or tiles). The access floor of the present disclosure is able to sustain dynamic load conditions. The access floor of the present disclosure is particularly useful in areas of increased seismic activity (i.e., areas of increased frequency of earthquakes). The anti-seismic access floor of the present disclosure maintains its structural integrity in the case of a seismic event, when horizontal and/or vertical forces are acting on the flooring elements. The anti-seismic access floor of the present disclosure prevents the disengagement of the flooring elements from their respective base supports, and ensures the proper relative positioning of the flooring elements between other flooring elements during and after seismic events.

The access floor of the present disclosure is also generally useful to ensure an accurate positioning of flooring elements over their respective base supports and between other flooring elements without causing instability during the use, maintenance and removal of the same flooring elements. Additionally, the access floor of the present disclosure enables easy maintenance and removal of the flooring elements.

Figure 1:
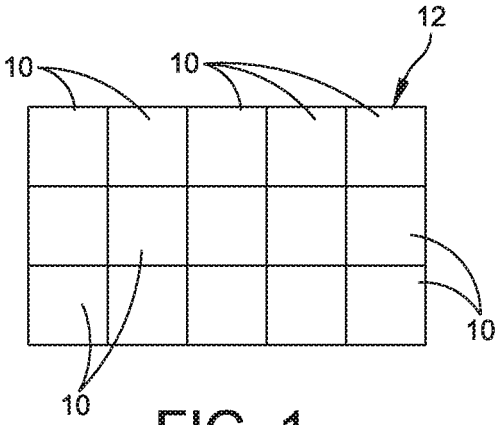
FIG. 1 (PRIOR ART)
FIG. 1 is a top view of a prior art array of flooring elements.
Figure 2:
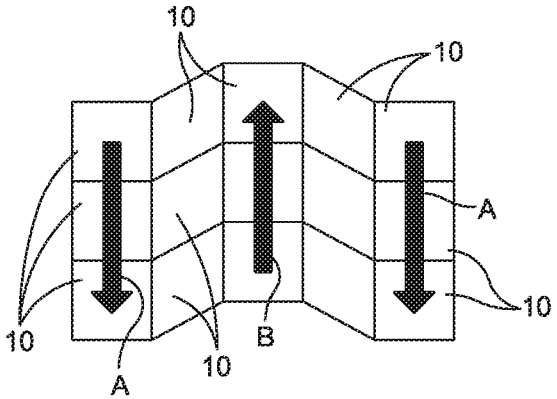
FIG. 2 (PRIOR ART)
FIG. 2 is another view of the prior art array of flooring elements in response to lateral loads.
Figure 3:
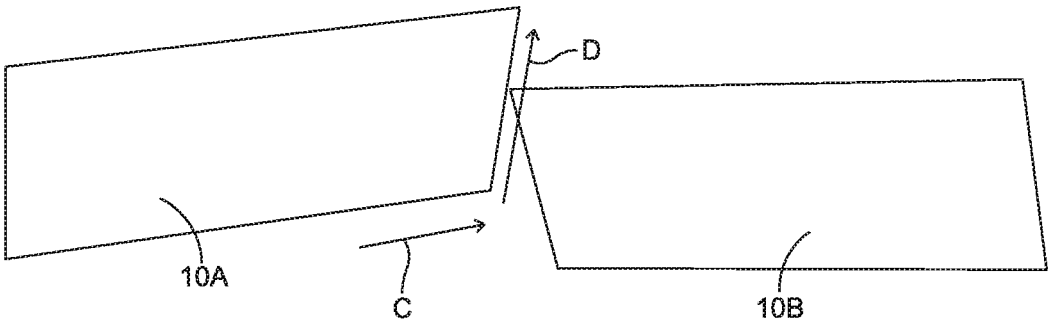
FIG. 3 (PRIOR ART)
FIG. 3 is a side view of the prior art array of flooring elements responding to seismic loads.
Figure 4:
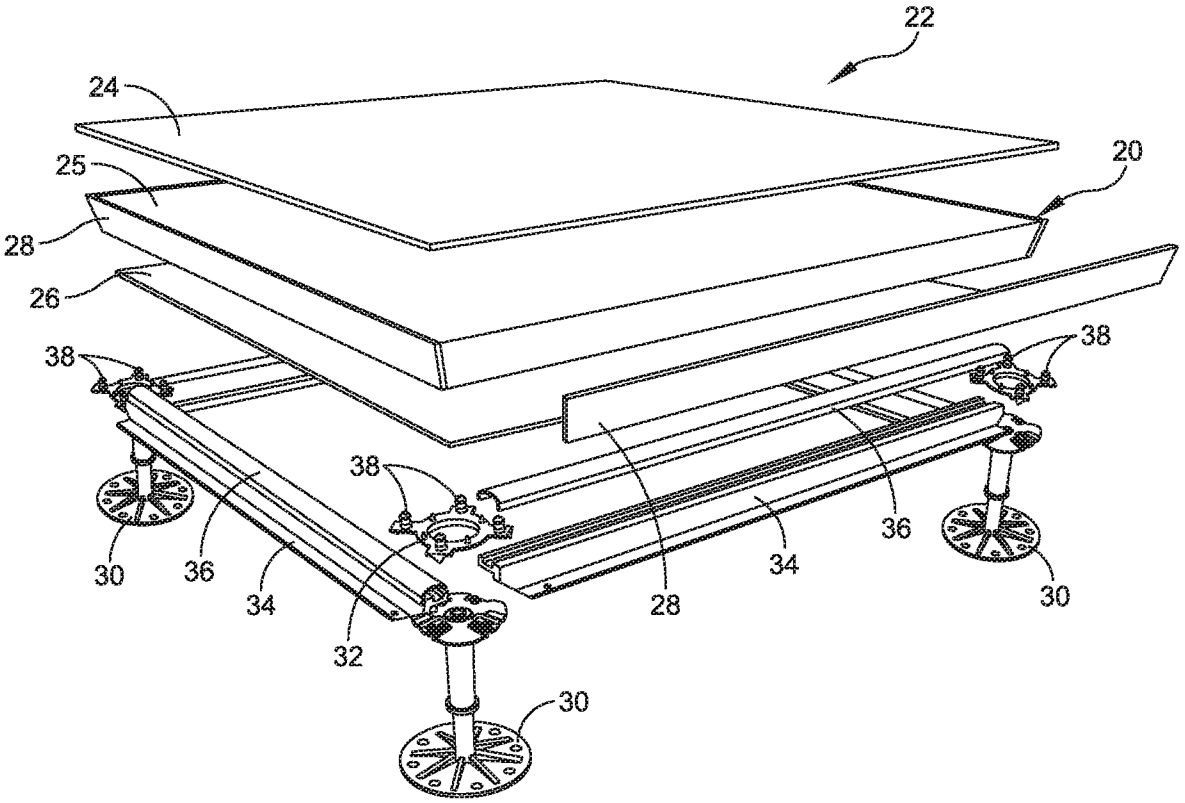
FIG. 4 is a partially exploded perspective view of a raised access floor system according to an embodiment of the present disclosure.

Referring now to FIG. 4, a raised access floor system is generally indicated at 22. The raised access floor system 22 includes a flooring element (or flooring element assembly) 20 having a finishing surface 24 on a top surface of the flooring element core 25, and a backing 26 on a bottom surface of the flooring element core 25. The raised access floor system 22 further includes four edge surface elements, each indicated at 28, which may be made of plastic. The edge surface elements extend along four side walls of the flooring element core 25. In some embodiments, the flooring element 20 may be an integrally formed structure. In some embodiments, the flooring element 20 does not include a finishing surface or a backing surface. The flooring element 20 is supported at its four corners by four pedestals (or bases or base supports) 30. In one embodiment, each pedestal 30 may include a head gasket 32 secured to an upper end of the respective pedestal 30. In another embodiment, each pedestal 30 may simply embody a base. Four stringers, each indicated at 34, extend between the upper ends of the bases 30, with each stringer 34 being configured to support a respective stringer gasket 36.

In some embodiments, the flooring elements are supported by pedestals 30, and there are no stringers provided.

In some embodiments, the flooring elements 20 are configured to support electronic components. In some embodiments, the flooring elements 20 are configured for use in office spaces, where the flooring elements 20 support furniture and people. In some embodiments, the flooring elements 20 are used in electrical rooms and support electrical switchboards. In some embodiments, the flooring elements 20 are configured for other raised floor applications.

When employing pedestals 30, each head gasket 32 supports a set of four pins, each indicated at 38, to secure the flooring elements 20 to the head gasket 32, and thereby to the pedestals 30. The head gasket 32 is optional, and is shown in some figures but not in other figures.

Figure 5:
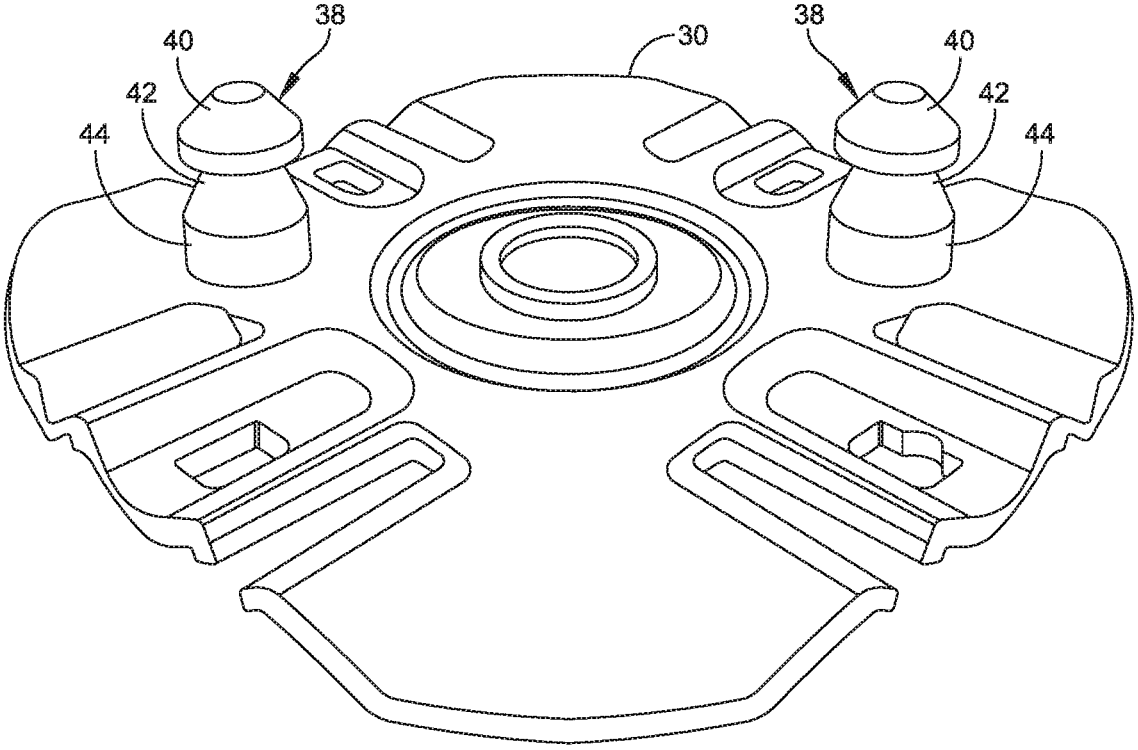
FIG. 5 is a perspective view an embodiment of a base with two pins of the raised access floor system.

Referring now to FIG. 5, two pins 38 are shown to extend up from the base support 30, without a head gasket 32. Each pin 38 is dimensioned and configured for providing locking engagement between the base support 30 and the flooring element 20. Each pin 38 includes a head portion 40, a tapered neck portion 42, and a body portion 44.

While FIG. 5 shows only two pins on a base, some embodiments include four pins 38 secured to each base support 30, so that each one of the four pins 38 engages a respective corner of one of four flooring elements 20.

Figure 6:
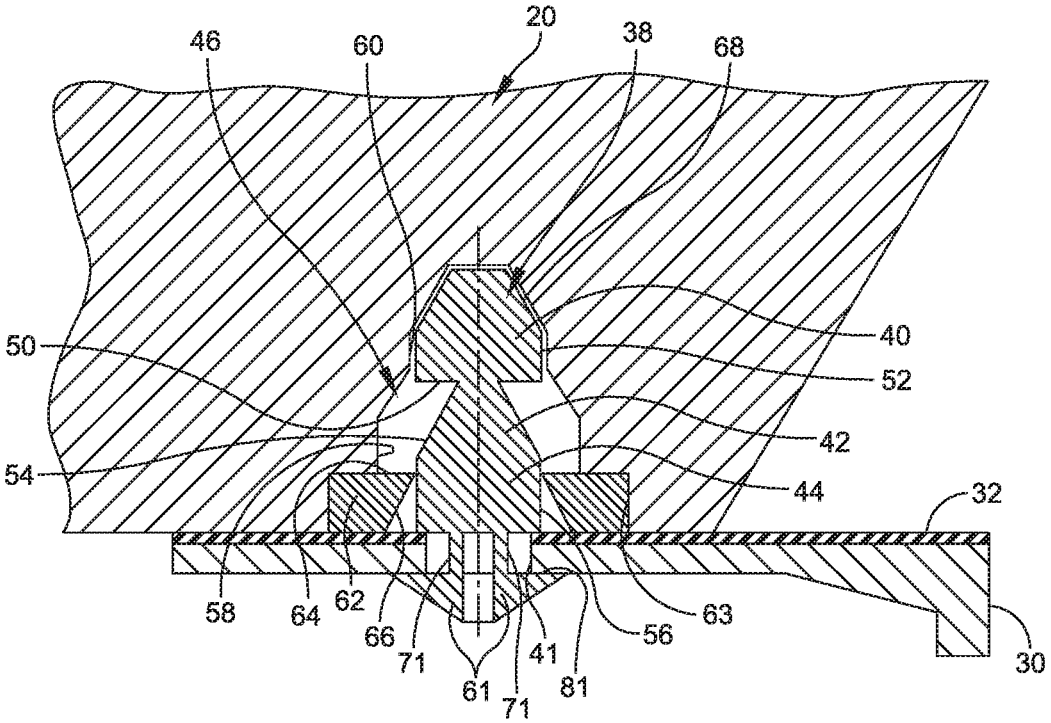
FIG. 6 is a cross section of one of the pins of FIG. 5 received in a pin receiver defined in a flooring element of the raised access floor system.

FIG. 6 shows a cross section of one of the pins 38 of FIG. 5 received in a pin receiver 46 defined by a recess formed in a flooring element 20. In the raised access floor system 22 of the present disclosure, at least one corner of each flooring element 20 is provided with the pin receiver 46, shaped in order to receive a respective pin 38 that is secured to a base support 30. The pin receiver 46 is dimensioned and configured to retain the pin 38 inside the pin receiver 46 when a combination of horizontal and vertical forces acts on the flooring element 20 of the access floor.

In some embodiments, the base support 30 is fabricated from a suitable metal. In additional embodiments, the pins 38 can be fabricated from metal or plastic.

As discussed above, when employing a pedestal 30, the gasket (or head gasket) 32 extends over an upper surface of the pedestal (or base, or base support) 30. The gasket 32 has an upper surface configured to engage a lower surface of the flooring element 20.

In some embodiments, the pins 38 are formed integrally with the gasket 32. In such embodiments, the gasket 32 is firmly connected to the pedestal 30 by means of glue or specific locking teeth.

In FIG. 6, the pin 38 is secured to the base support 30. The pin 38 is seated above the gasket 32 on the base support 30, and extends from an upper surface of the base support 30. The body portion 44 of the pin 38 is adjacent to the gasket 32 on the base support 30. The head portion 40 of the pin 38 extends upwardly from the body portion 44. The head portion 40 has a lower head surface 50.

The tapered neck portion 42 of the pin 38 extends upwardly from the body portion 44, and connects the body portion 44 to the head portion 40. The head portion 40 has an annular head wall 52. The lower head surface 50 extends inwardly from the annular head wall 52. The tapered neck portion 42 has a tapered neck wall 54 depending downwardly and radially outwardly from the neck portion upper edge that connects to the lower head surface 50. The body portion 44 has an annular body wall 56 depending from the tapered neck wall 54.

In FIG. 6, the annular body wall 56 has a diameter equal to a diameter of the annular head wall 52. In some embodiments, the annular body wall 56 and the annular head wall 52 may have different diameters.

To receive the pin 38, the pin receiver 46 of the respective flooring element 20 includes a first counterbore 58 and a second counterbore 60 recessed from the first counterbore 58. The first counterbore 58 has a diameter that is greater than a diameter of the second counterbore 60. The raised access floor system 22 further includes a collar 62 positioned within the pin receiver 46 adjacent to the first counterbore 58. Specifically, the collar 62 is seated in an annular recess 63 defined in the flooring element 20. The first counterbore 58 diameter is greater than an inner diameter of the collar 62. This allows the pin to move laterally within the first counterbore 58. This lateral movement, along with the geometry of the head portion 40 and the tapered neck portion 42 of the pin 38 enables the pin to be retained by the collar 62 as the collar moves upwardly.

In one embodiment, the first counterbore 58 and the second counterbore 60 are defined near a corner of the flooring element 20.

The geometry of the pin 38, pin receiver 46, and collar 62 allows for vertical movement of the flooring element 20 with respect to the base support 30. The diameters of the first counterbore 58 and the second counterbore 60, and the inner diameter of the collar 62, provide sufficient clearance with an outer surface of the pin 38, which allows a user to easily remove the flooring element 20 from the base support 30 by causing vertical movement of the pin receiver 46 of the flooring element 20 with respect to the pin 38 that is secured to the base support 30. In particular, the diameters of the first counterbore 58 and the second counterbore 60, and the inner diameter of the collar 62, provide sufficient clearance with the annular head wall 52 of the head portion 40 and the annular body wall 56 of the body portion 44, which allows a user to easily remove the flooring element 20 from the base support 30 by causing vertical movement of the pin receiver 46 of the flooring element 20 with respect to the pin 38 that is secured to the base support 30. This facilitates installation of the flooring element 20 and removal of the flooring element 20.

However, the pin 38 and pin receiver 46 are configured to limit vertical movement of the flooring element 20 with respect to the base support 30 when lateral loads are introduced on the flooring element 20 with respect to the base support 30. In particular, the pin 38 and pin receiver 46 are dimensioned and configured to limit the movement of the flooring element 20 from the base support 30 in response to a seismic load.

The raised access floor system 22 of the present disclosure locks flooring elements 20 to prevent each flooring element 20 from skipping over an adjacent flooring element. Additionally, by retaining each flooring element 20 in its position, the system 22 prevents the understructure of the system 22 from change its square shape. That is, the flooring element 20 prevents the stringer 34 layout from deforming from a square to a rhombus when viewed from above. The combination of these functions prevents each flooring element 20 from falling down between the stringers 34.

The collar 62 has an upper collar surface 64 configured to engage the lower head surface 50 of the head portion 40 of the pin 38 to limit a vertical motion of the flooring element 20 with respect to the base support 30 when a central vertical axis of the pin 38 is laterally offset from a central vertical axis of the first counterbore 58 of the pin receiver 46, for example, by a lateral offset distance that is greater than the clearance between the pin 38 and the collar 62.

The collar 62 has a tapered inner wall 66 configured to engage the tapered neck wall 54 of the tapered neck portion 42 of the pin 38. The tapered neck wall 54 of the tapered neck portion 42 of the pin 38 and the tapered inner wall 66 of the collar 62 allow the upper surface 64 of the collar 62 to engage the lower head surface 50 of the head portion 40 when a combination of vertical and lateral loads are applied to the flooring element 20 with respect to the base support 30.

The base support 30 includes an opening 41 that is sized to receive the pin 38 therein. In some embodiments, the pin 38 has at least one annular latching tab 61 extending from a lower end of the body portion 44 of the pin 38. In a certain embodiment, the latching tab 61 has a diameter larger than a diameter of the opening 41 to retain the pin 38 in place with respect to the base support 30. The latching tab 61 has a latching surface 81 configured to releasably engage a lower surface of the base support 30.

In some embodiments, the latching tab 61 is connected to the body portion 44 of the pin by a connecting portion (or flexible arm) 71.

In some embodiments, a set of tabs is used in place of the annular latching tab 61.

In some embodiments, the pin is secured to the base by a threaded fastener. In some embodiments, the pin is secured to the base by a weld.

In some embodiments, the first counterbore and the second counterbore are positioned at a corner of the flooring element. In some embodiments, the first counterbore and the second counterbore are defined at other positions on the lower surface of the flooring element.

During installation, the pin receiver 46 of the floor element 20 is automatically centered over the pin 38 of the respective base support 30 due to an upper sloped surface 68 on the head portion 40 of the pin 38 and the tapered inner wall 66 of the collar 62. These surfaces ensure the correct positioning of the flooring element 20 and the alignment of all of the flooring elements 20 relative to each other. In the reverse way, it is possible to easily remove the flooring elements (i.e., for maintenance) by lifting them vertically.

Figure 7A:
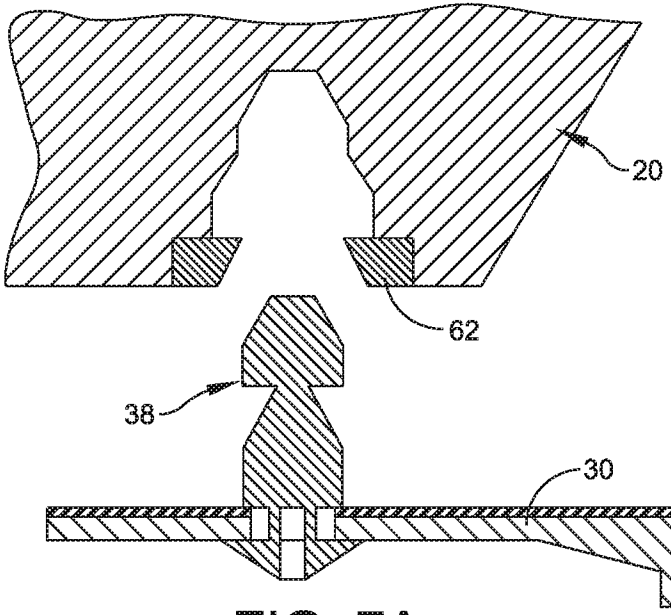
FIGS. 7A-7C are cross sectional views of the flooring element being installed on a base.
Figure 7B:
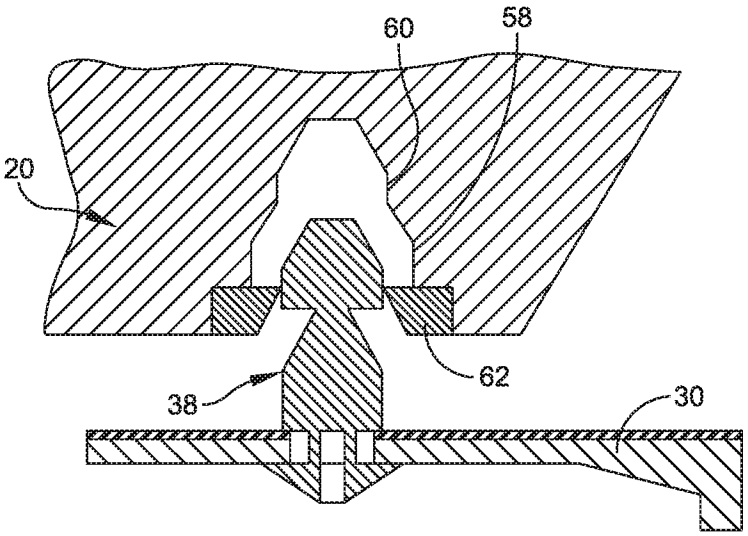
Figure 7C:
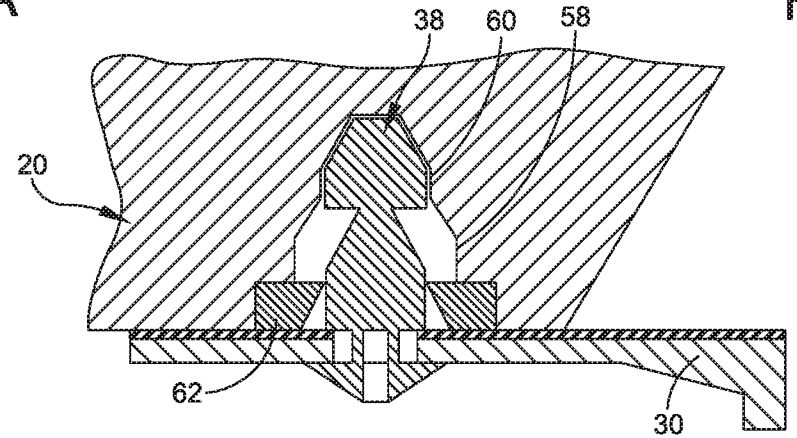

A process of installation of a flooring element 20 on a base support 30 is shown in the progression of FIG. 7A to FIG. 7B, and finally to FIG. 7C, in which the lower surface of the flooring element 20 is seated on the upper surface of the base support 30. Similarly, a process of removing a flooring element 20 from the base support 30 is shown in the reverse progression of FIG. 7C to FIG. 7B, and finally to FIG. 7A.

Figure 8:
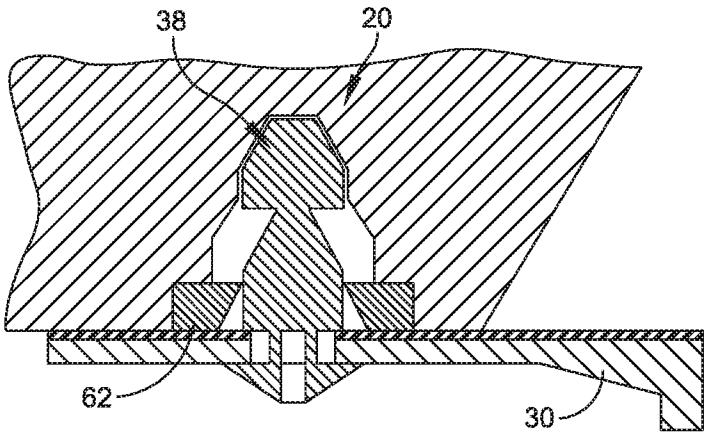
FIGS. 8-11 illustrate a dynamic loading response of the flooring element in an embodiment of the raised access floor system.
Figure 9:
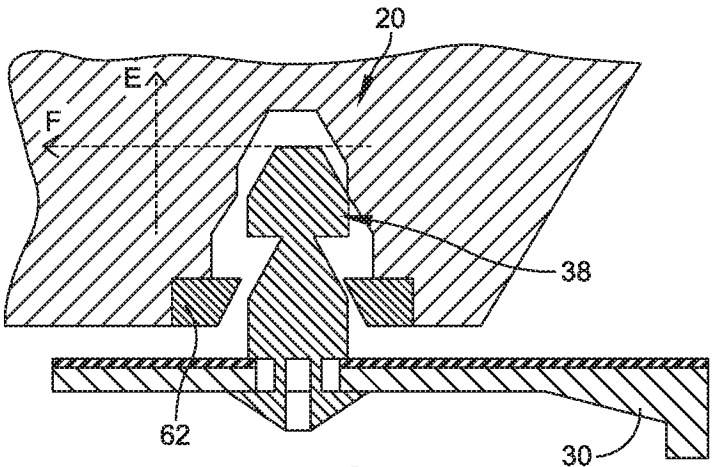
Figure 10:
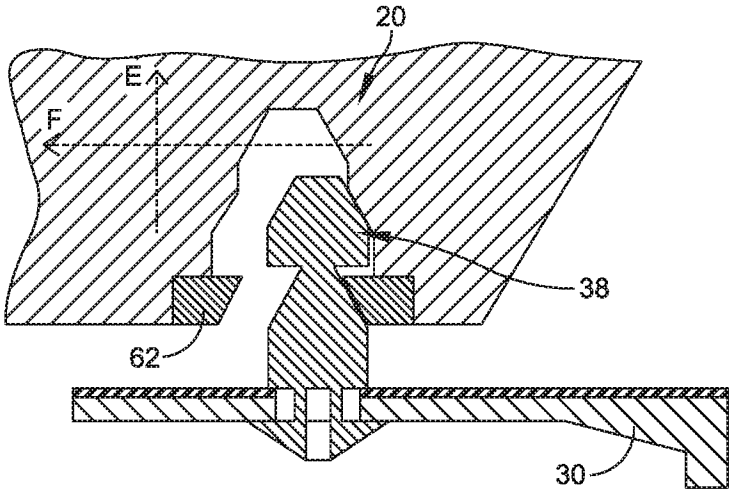
Figure 11:
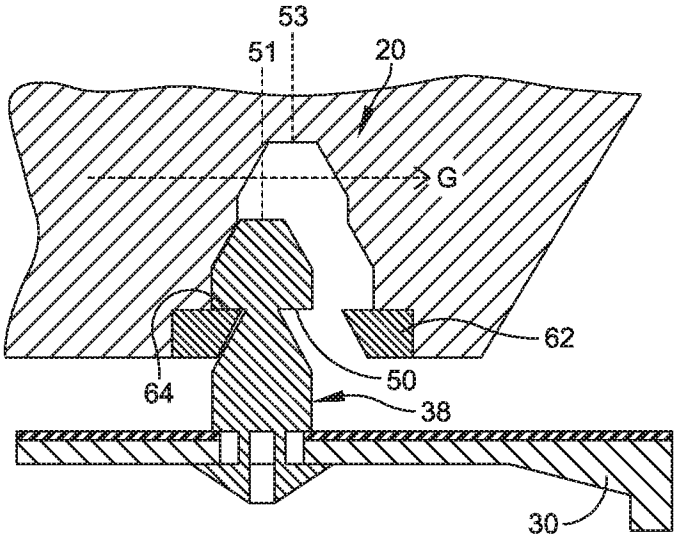
Figure 12:
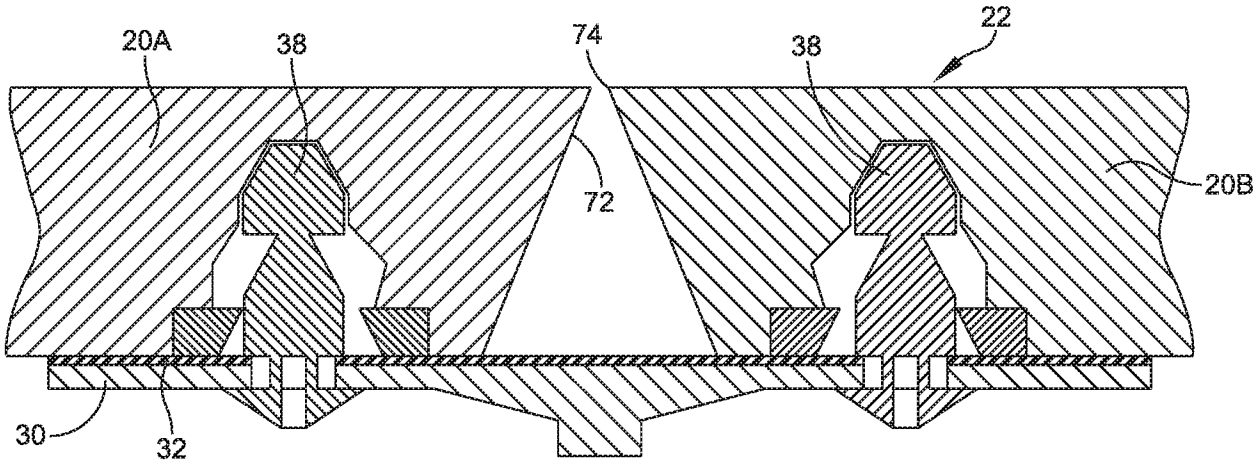
FIGS. 12-15 illustrate a dynamic loading response of two flooring elements in an embodiment of the raise access floor system.
Figure 13:
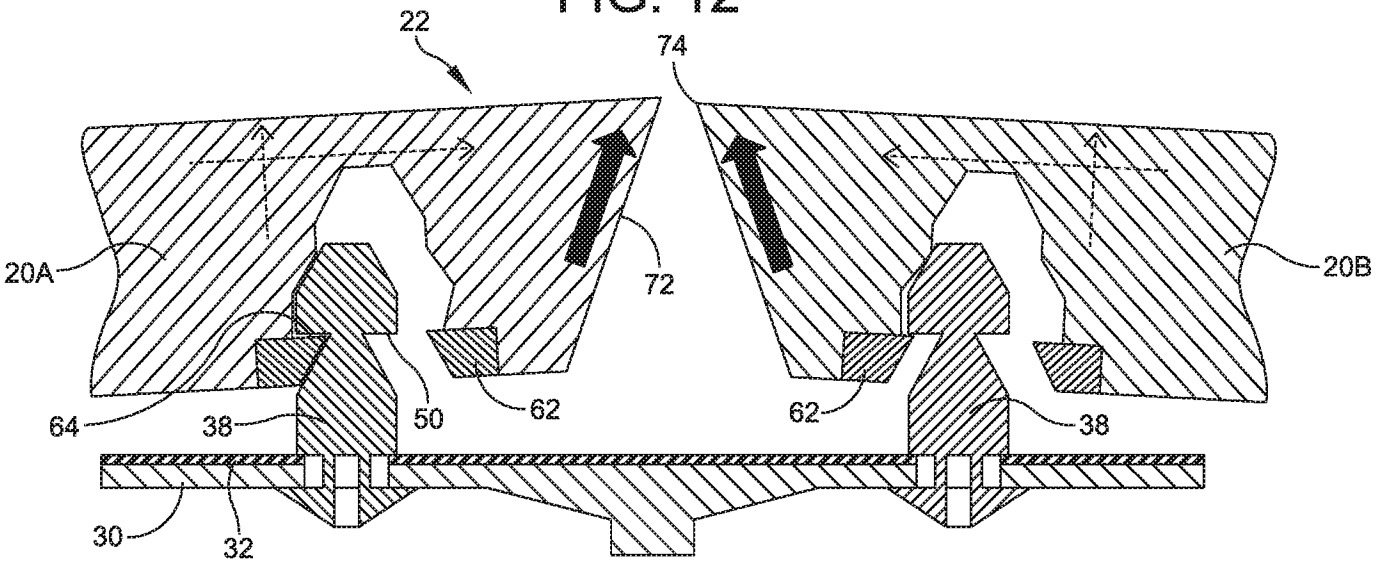
Figure 14:
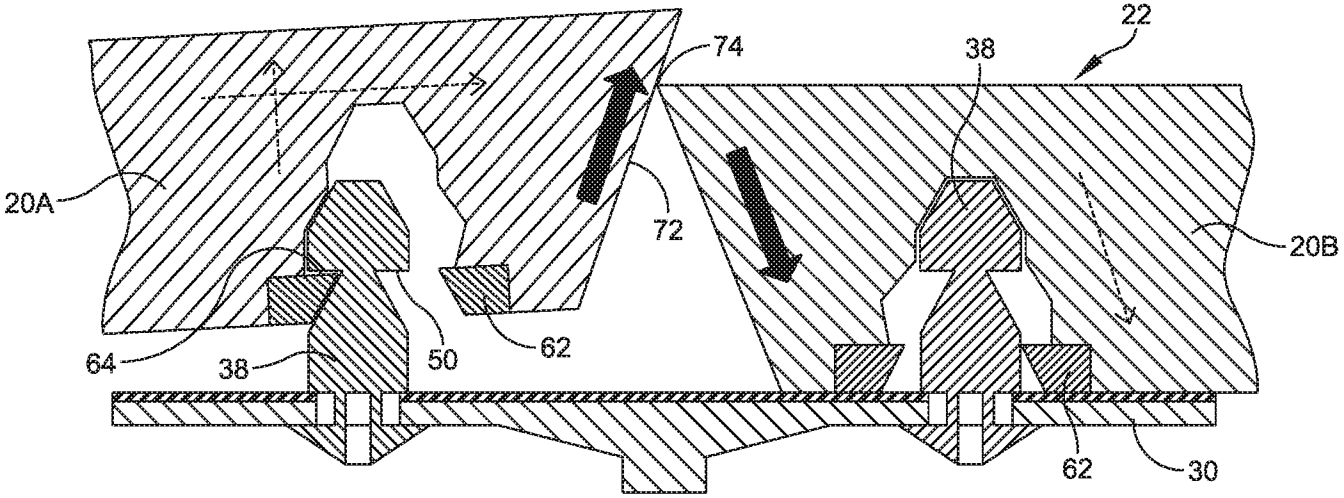
Figure 15:
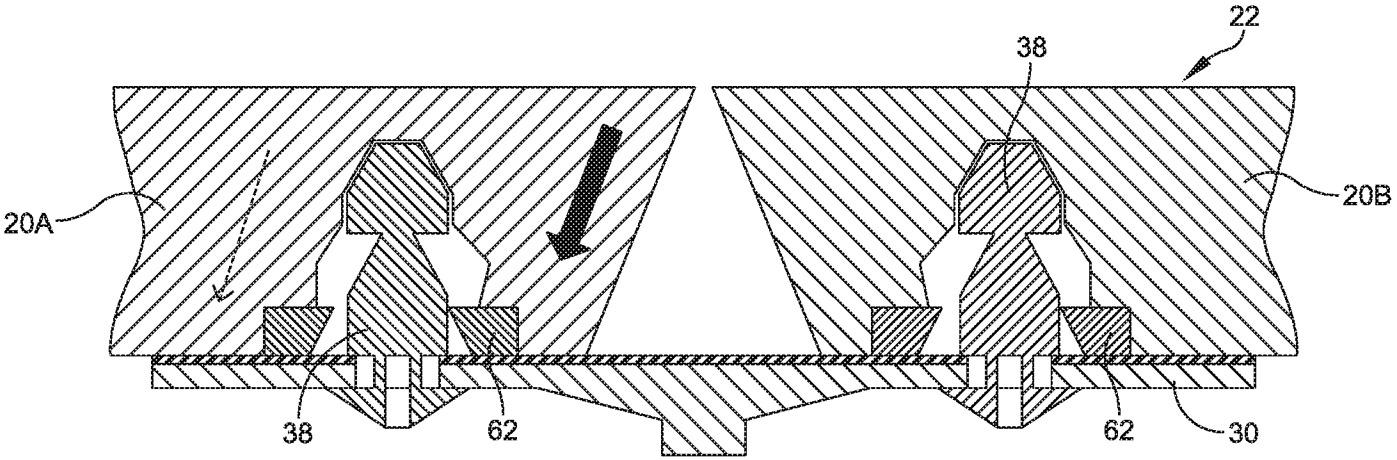

In the case of dynamic stress conditions (e.g., vibrations and earthquakes), the presence of horizontal (lateral) and vertical (elevational) forces may cause some or all flooring elements 20 to begin to oscillate and tremble. Consequently, the flooring elements 20 usually lift gradually from the rest position (such as the position shown in FIG. 6), with the final result that each or some of the flooring elements 20 or rows of flooring elements can partially overcome the adjacent ones making the access floor unstable and unsafe for users to walk on. The raised access floor system 22 of the present disclosure prevents flooring elements from disengaging respective base supports due to the peculiar geometry of the pin, pin receiver, and (in some embodiments) a collar. FIG. 8 shows a system at rest before a vertical load is applied to the flooring element. The progression from FIG. 9 to FIG. 10 shows the system of FIG. 8 as a combination of a load in a vertical direction E and a load in a horizontal direction F are applied to the flooring element 20. FIG. 11 shows the system when the lateral load is applied in an opposite direction G.

In FIG. 11, a central vertical axis 51 of the pin 38 is laterally offset from a central vertical axis 53 of the first counterbore 58, and the upper collar surface 64 engages the lower head surface 50 to limit an upward vertical motion of the flooring element 20 with respect to the base support 30.

Referring now to FIGS. 12-15, the anti-seismic access floor 22 of the present disclosure prevents undesired removal of the flooring elements 20A, 20B from their respective pins 38 on the base support 30 in response to seismic loads. When the flooring elements 20A, 20B move in response to a combination of vertical forces and horizontal (lateral) forces, as typically occurs in a seismic event, the flooring element 20A sloped edge 72 begins to slide up over the upper edge 74 of the adjacent element 20B, thereby shifting the flooring element 20A laterally while moving the flooring element 20A vertically. When this happens in FIG. 13 and FIG. 14, the upper surface 64 of the collar 62 engages the lower head surface 50 of the head portion 40 of the respective pin 38 to prevent the flooring element 20A from skipping over the adjacent flooring element 20B. When the vertically upwards movement of the flooring element 20A is thus stopped, and when there are insufficient external vertically upward forces, the flooring element 20A falls down again to its original position in FIG. 15, due to the sloped surface 68 on the head portion 40 of the pin 38, and due to the tapered neck wall 54 surface with the collar surface 66. The cycle can be repeated several times and for all the floor elements, without excessive damage to the flooring system.

Thus, when seismic loads are removed from the flooring element 20, the flooring element 20 returns to a position in which the central vertical axis 51 of the pin 38 is at least substantially aligned with the central vertical axis 53 of the first counterbore. To remove the flooring element 20 from the base support 30, a user lifts the flooring element vertically upward with respect to the base. To replace the flooring element on the base support 30, the user at least substantially aligns the central vertical axis 51 of the pin 38 with the central vertical axis 53 of the first counterbore, and lowers the flooring element 20 onto the pin base support 30.

Figure 16:
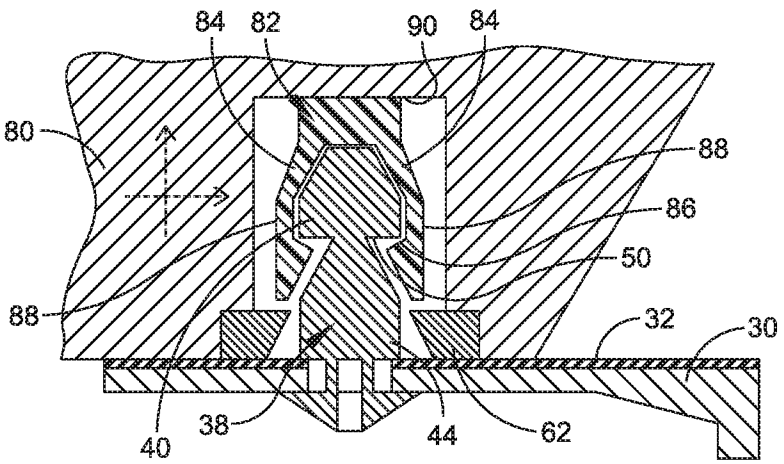
FIG. 16 is a cross sectional view of another embodiment of a connection assembly.

FIG. 16 shows another embodiment of a flooring element 80 of an anti-seismic access floor of the present disclosure. The assembly of FIG. 16 includes a base support 30 having an upper surface, and a pin 38 secured to the base support 30. The pin 38 extends from the upper surface of the base 30. The pin 38 and the base support 30 are the same as the pin 38 and base support 30 shown in FIG. 6.

The flooring element 80 has a locking pin receiver 82 positioned in a recess 90 defined in the flooring element 80. The locking pin receiver 82 has at least two petals 84 extending radially and downwardly from a main body of the locking pin receiver 82. In one embodiment, the petals 84 are configured to releasably secure the flooring element 80 to the pin 38 and the base support 30. In other embodiments, the locking pin receiver may have more than two petals 84. Each petal 84 has a locking petal surface 86 configured to releasably engage the lower head surface 50 of the head portion 40 of the pin 38. Each petal 84 has an elastically deformable leaf portion 88 to enable the radial movement of the locking petal surface 86.

Figure 17:
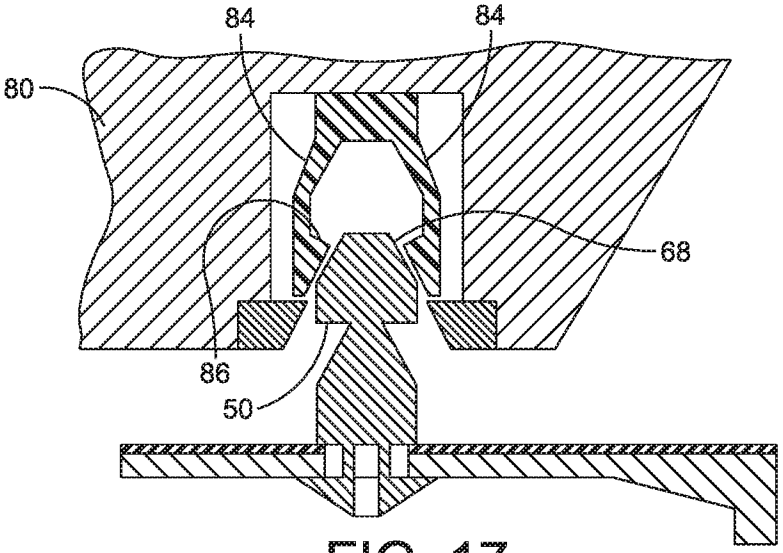
FIGS. 17-19 illustrate the operation of the connection assembly.
Figure 19:
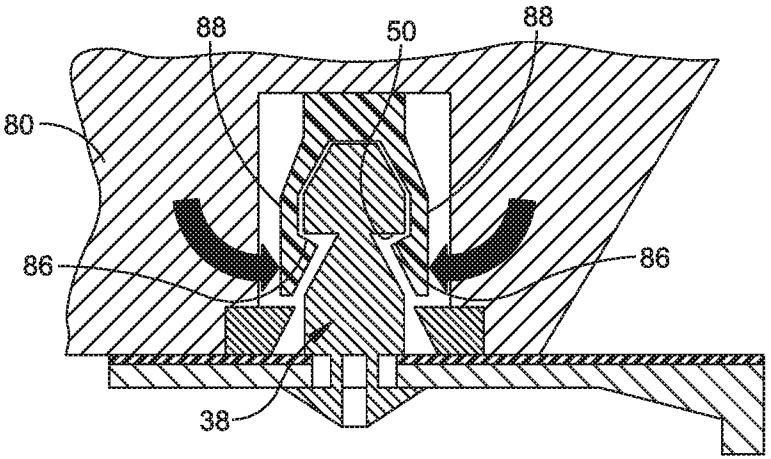
Figure 18:
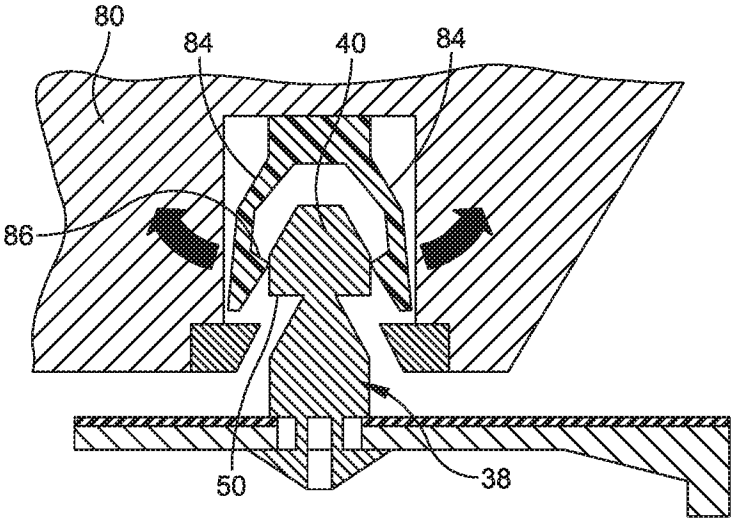

FIG. 17 shows the flooring element 80 before the pin 38 has been received by the locking petals 84 of the locking pin receiver 82. FIG. 18 shows how advancing the flooring element 80 downwardly towards the base support 30 causes the head portion 40 of the pin 38 to push the petals 84 outwardly, elastically deforming the leaf portion 88 of each petal 84. In FIG. 19, the flooring element 80 has been moved far enough downwardly that the leaf portions 88 of the petals 84 spring back inwardly so that each locking petal surface 86 engages the lower head surface 50.

A user may disengage the pin 38 from the petals 84 by applying sufficient upward force to the flooring element 80 at the location of the locking pin receiver 82 to cause the sloped locking petal surfaces 86 to disengage the lower head portion surface 50 of the head portion 40 of the pin 38. The vertical removal force is greater than a typically expected vertical seismic load.

In the flooring element embodiment 80 of FIGS. 16-19, the collar 62 is not required, because the sloped locking petal surfaces 86 of the locking pin receiver 82 engage the lower head portion surface 50 to maintain the connection of the flooring element 80 to the base support 30.

The petals can be improved with a mechanical locking system able to lock the flooring element 80 in engagement with the base support 30 in case of high energy phenomena, for example, in the case of electrical arc in medium voltage/high voltage (MV/HV) switchboard rooms. In this case, the petals 84 are locked in engagement with the head portion 40 of the pin 38 by a metallic ring (or retaining ring, or ring) 92 as illustrated in FIG. 20.

Figure 21:
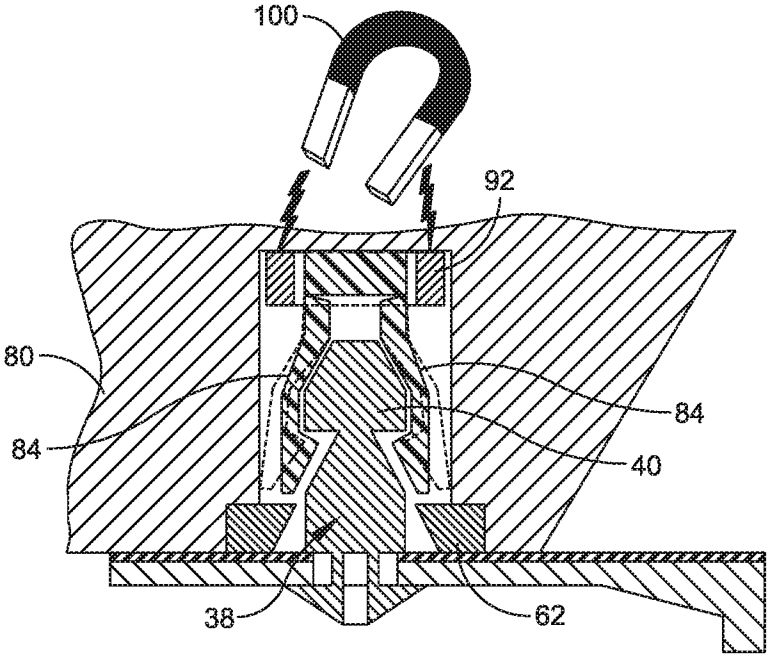
FIG. 21 is a cross sectional view of the embodiment of the connection assembly shown in FIG. 16 including the ring in a second position.
Figure 20:
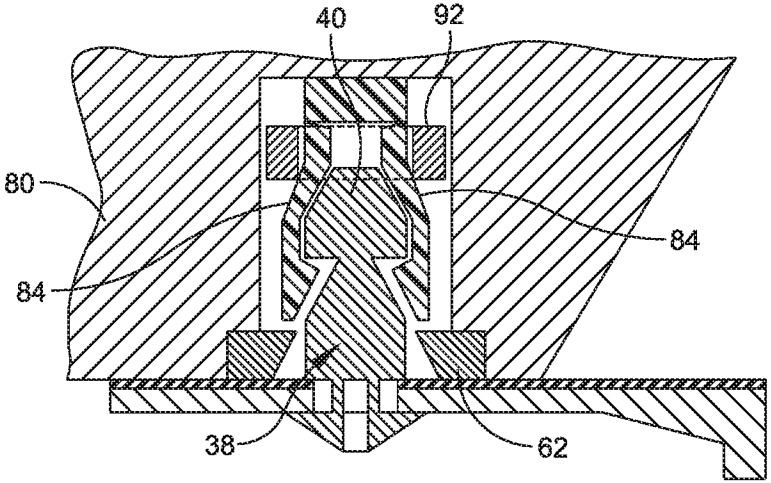
FIG. 20 is a cross sectional view of the embodiment of the connection assembly shown in FIG. 16 including a ring in a first position.

FIGS. 20-21 show the embodiment of FIGS. 16-19 with a magnetic retaining ring 92 installed to retain the locking pin receiver 82 in a fixed position around the head portion 40 of the pin 38. The ring 92 is movable from a first position to a second position. FIG. 20 shows the ring 92 in the first position, in which the ring 92 retains the at least two petals 84 at an inward position so the petals 84 interfere with a vertical removal movement of the lower head surface 50 in relation to the base support 30. The ring 92 is pulled down by gravity, locking the petals 84 against the head portion 40 of the pin 38.

When the magnetic fields of the magnet 100 and the ring 92 are properly aligned, the ring 92 is moved upwardly to the second position. Thus, to remove the flooring element 80 from the base support 30, a user positions the special magnetic tool 100 on top of the flooring element 80, pulling the ring 92 and thereby setting the petals 84 free to release the pin 38 when a sufficient vertical removal force is applied to the flooring element 80. FIG. 21 shows the ring 92 in the second position, in which the ring 92 allows the lower head surface 50 to disengage the petals 84 when a user applies sufficient upward force to the flooring element.

In the embodiment of FIGS. 20 and 21, the collar 62 is shown, but is not required.

Figure 22:
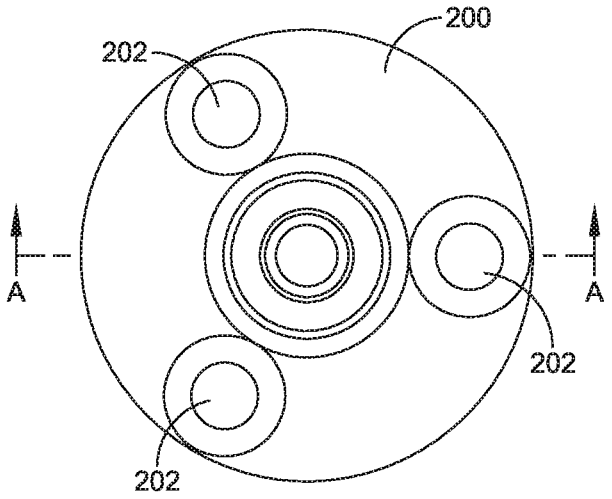
FIG. 22 is a top plan view of another embodiment of a base.
Figure 23:
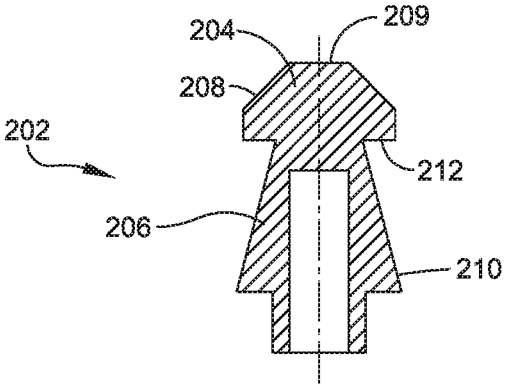
FIG. 23 is a cross sectional view of a pin shown in FIG. 22.

FIG. 22 shows a top view of an embodiment of a base support 200 having three pins 202 secured to the base support 200. FIG. 23 shows a cross section of a pin 202 of FIG. 22 through the line A-A. Each pin 202 has a head portion 204 and a tapered neck portion 206. A sloped upper surface 208 on the head portion 204 extends at an angle of 45° with respect to the horizontal upper end 209 of the head portion 204. A tapered wall 210 of the neck portion 206 extends at an angle of 75° with respect to the horizontal lower head portion surface 212.

Figure 24:
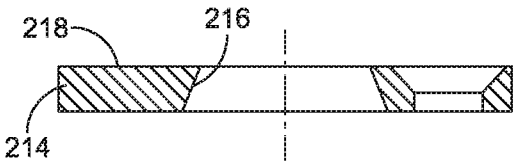
FIG. 24 is a cross sectional view of a collar provided to engage the pin shown in FIG. 23.

FIG. 24 shows a collar 214 for restraining the vertical movement of a flooring element with respect to the pin 202. A tapered collar wall 216 of the collar 214 is a frustoconical wall having a cone angle of 45°. An upper collar surface 218 of the collar 214 is configured to engage the lower head portion surface 212 of the pin 202 when the collar 214 is installed in a flooring element.

In some embodiments, the tapered collar wall 216 of the collar 214 is a frustoconical wall having a cone angle that is other than 45°.

Figure 25:
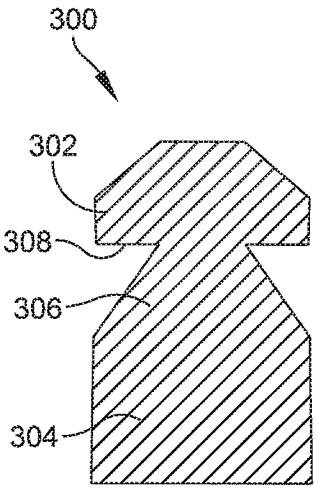

FIG. 25 shows a cross section of an embodiment of a plastic pin 300 having a head portion 302, a body portion 304, and a tapered neck portion 306, with an overall height of 16 millimeters. In one embodiment, the head portion 302 of the pin 300 has a diameter of 10 millimeters and the body portion 304 of the pin has a diameter of 11 millimeters. The tapered neck portion 306 has an upper diameter of 6 millimeters, thereby defining a lower surface 308 of the head portion 302.

Figure 26:
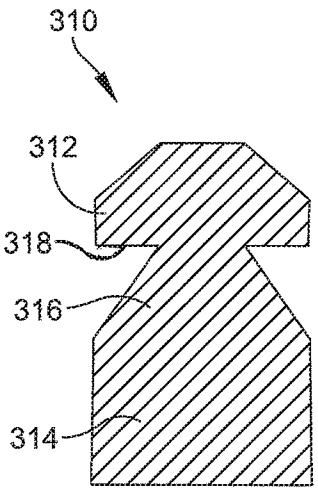

FIG. 26 shows a cross section of an embodiment of a metallic pin 310 having a head portion 312, a body portion 314, and a tapered neck portion 316, with an overall height of 16 millimeters. In one embodiment, the head portion 312 of the pin 310 has a diameter of 10 millimeters and the body portion 314 of the pin has a diameter of 10 millimeters. The tapered neck portion 316 has an upper diameter of 7 millimeters, thereby defining a lower surface 318 of the head portion 312.

Figure 27:
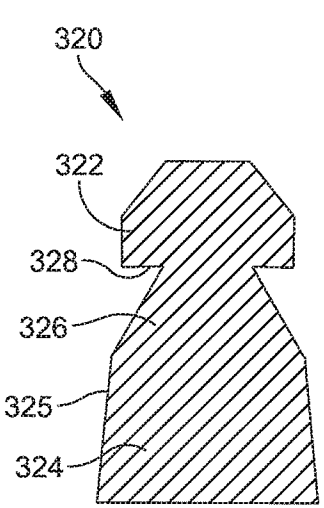
FIGS. 25-27 are cross sectional views of various embodiments of pins.

FIG. 27 shows a cross section of yet another embodiment 320 of a pin having a head portion 322, a body portion 324, and a tapered neck portion 326, with an overall height of 16 millimeters. In one embodiment, the head portion 322 of the pin has a diameter of 9 millimeters and the body portion 324 of the pin 320 has a diameter of 11 millimeters at its base. The body portion 324 has a tapered wall 325 that extends to the neck portion 326. The lower end of the neck portion 326 has a diameter of 10 millimeters. The tapered neck portion 326 has an upper diameter of 6 millimeters, thereby defining a lower surface 328 of the head portion 322.

Figure 29:
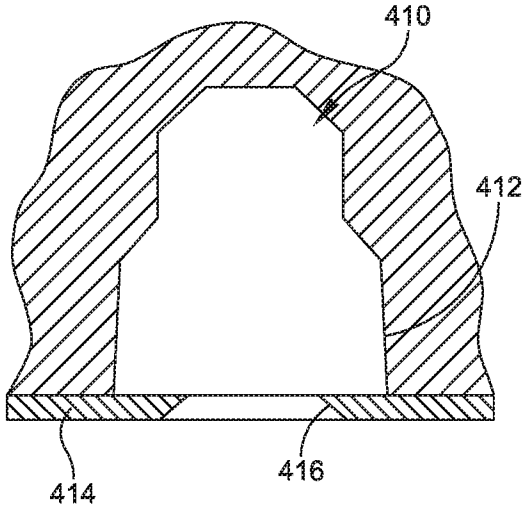
FIGS. 28 and 29 are cross sectional views of various embodiments of pin receivers.
Figure 28:
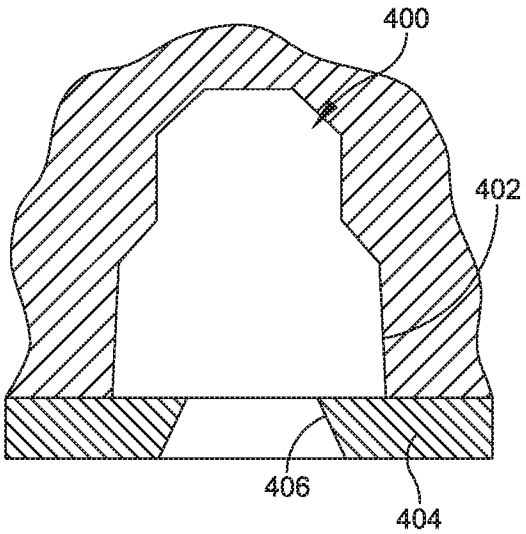

Each of the pins of FIGS. 25-27 may be used to engage a pin receiver, such as the pin receivers shown in FIGS. 28 and 29. FIG. 28 shows a pin receiver 400 having a first counterbore 402 having a diameter of 14 millimeters and a collar 404 having an inner collar diameter of 11.5 millimeters. An opening defined by the tapered collar wall 406 has an upper diameter of 11.5 millimeters and a lower diameter of 13 millimeters. The outer diameter of the collar is 30 millimeters. The collar 404 is 3 millimeters in height.

FIG. 29 shows a pin receiver 410 having a first counterbore 412 having a diameter of 14 millimeters and collar 414 having an inner collar diameter of 11.5 millimeters. An opening defined by the tapered collar wall 416 has an upper diameter of 11.5 millimeters and a lower diameter of 13 millimeters. The collar 414 is 0.5 millimeters in height.

The pins of FIGS. 25-27 and the pin receivers of FIGS. 28-29 are provided as examples, and are not intended to limit the scope of the present disclosure.

Although at least some embodiments are discussed in relation to an entire flooring system, the present disclosure provides a connection assembly that can be incorporated into an existing access floor. Generally, the present disclosure provides a connection assembly for an access floor in which the connection assembly includes a pin and a pin receiver. The pin receiver has at least one surface that is configured to engage a surface on the pin, such as a lower surface of a head portion of the pin, to prevent disengagement of a first component secured to the pin receiver from a second component secured to the pin.

Embodiments are not limited in their application to the details of construction and the arrangement of components set forth in the following description or illustrated in the drawings. Also, the phraseology and terminology used herein is for the purpose of description and should not be regarded as limiting. The use of "including," "comprising,"

or "having," "containing," "involving," and variations thereof herein, is meant to encompass the items listed thereafter and equivalents thereof as well as additional items.

Having thus described several aspects of at least one embodiment, it is to be appreciated various alterations, modifications, and improvements will readily occur to those skilled in the art. Such alterations, modifications, and improvements are intended to be part of this disclosure, and are intended to be within the scope of the disclosure. Accordingly, the foregoing description and drawings are by way of example only.

What is claimed is:

1. A flooring assembly comprising:

a base having an upper surface;

a pin secured to the base and extending from the upper surface of the base, the pin having a body portion adjacent to the base and a head portion extending upwardly from the body portion, the head portion having a lower head surface;

a flooring element having a recess formed therein, the recess having a diameter; and a collar positioned adjacent to the recess, the collar having an inner diameter that is less than the diameter of the recess, the inner diameter of the collar being greater than an outer diameter of the pin, wherein the collar has an upper collar surface configured to engage the lower head surface to limit a vertical motion of the flooring element with respect to the base when a central vertical axis of the pin is laterally offset from a central vertical axis of the recess, and wherein, when the pin is received in the recess and when the central vertical axis of the pin is aligned with the central vertical axis of the recess, the collar and the pin permit vertical motion of the flooring element with respect to the base.

2. The flooring assembly of claim 1, wherein the pin has a tapered neck portion extending upwardly from the body portion and connecting the body portion to the head portion.

3. The flooring assembly of claim 1, wherein the head portion has an annular head wall, the lower head surface extending inwardly from the annular head wall, the neck portion having a tapered neck wall depending downwardly and radially outwardly from the lower head surface, and the body portion having an annular body wall depending from the tapered neck wall.

4. The flooring assembly of claim 3, wherein the collar has a tapered inner wall configured to engage the tapered neck wall.

5. The flooring assembly of claim 3, wherein the annular body wall has an annular body diameter equal to a diameter of the annular head wall.

6. The flooring assembly of claim 1, wherein the collar is seated in an annular recess defined in the flooring element.

7. The flooring assembly of claim 1, further comprising a gasket positioned on the upper surface of the base, the gasket having an upper surface configured to engage the flooring element.

8. The flooring assembly of claim 1, wherein the base has an opening formed therein, the pin having at least one latching tab extending from a lower end of the body portion of the pin, each of the at least one latching tab having a flexible arm, and the latching tab having a latching surface configured to releas ably engage a lower surface of the base when the flexible arm extends through the opening to secure the pin to the base.

9. The flooring assembly of claim 1, wherein the pin is secured to the base by one of a threaded fastener and a weld.

10. The flooring assembly of claim 1, wherein the recess of the flooring element includes a first counterbore and a second counterbore recessed from the first counterbore, a diameter of the first counterbore being greater than a diameter of the second counterbore, the first counterbore and the second counterbore being positioned at a corner of the flooring element.

11. The flooring assembly of claim 1, wherein the pin comprises a material selected from a metal and a plastic.

12. A flooring assembly comprising:

a base having an upper surface;

a pin secured to the base and extending from the upper surface of the base, the pin having a body portion adjacent to the base and a head portion extending upwardly from the body portion, the head portion having a lower head surface; and a flooring element having a locking structure positioned on a surface of a recess, the locking structure having at least two petals extending downwardly from the surface of the recess, each petal having a locking surface configured to releasably engage the lower head surface.

13. The flooring assembly of claim 12, further comprising a ring, the ring being movable from a first position to a second position, the ring being configured to retain the at least two petals in engagement with the lower head surface of the head portion when the ring is in the first position, and the ring being configured to allow the lower head surface to disengage the at least two petals when the ring is in the second position.

14. The flooring assembly of claim 13, wherein the ring is magnetic so that a magnetic field is capable of moving the ring from the first position to the second position.

15. A method of constructing a flooring assembly comprising:

providing a base having an upper surface;

providing a pin secured to the base and extending from the upper surface of the base, the pin having a body portion adjacent to the base and a head portion extending upwardly from the body portion, the head portion having a lower head surface;

providing a flooring element having a recess formed therein, the recess having a diameter, the flooring element having a collar positioned adjacent to the recess, the collar having an inner diameter that is less than the diameter of the recess, the inner diameter of the collar being greater than an outer diameter of the pin; and positioning the flooring element on the base by aligning a center axis of the pin with a center axis of the collar, and lowering a lower surface of the flooring element so that the pin is received in the recess, wherein the collar has an upper collar surface configured to engage the lower head surface to limit a vertical motion of the flooring element with respect to the base when the center axis of the pin is laterally offset from a central vertical axis of the recess, and wherein, when the pin is received in the recess and when the center axis of the pin is aligned with the central vertical axis of the recess, the collar and the pin permit vertical motion of the flooring element with respect to the base.

16. The method of claim 15, further comprising removing the flooring element from the base by aligning the center axis of the pin with the center axis of the collar and moving the flooring element vertically upward with respect to the base.

17. The method of claim 15, wherein the pin has a tapered neck portion extending upwardly from the body portion and connecting the body portion to the head portion.

18. The method of claim 15, wherein the head portion has an annular head wall, the lower head surface extending inwardly from the annular head wall, the neck portion having a tapered neck wall depending downwardly and radially outwardly from the lower head surface, and the body portion having an annular body wall depending from the tapered neck wall.

19. The method of claim 18, wherein the collar has a tapered inner wall configured to engage the tapered neck wall.

20. The method of claim 18, wherein the annular body wall has an annular body diameter equal to a diameter of the annular head wall.

* * * * *